US006378789B1

(12) United States Patent
Seaman, Jr. et al.

(10) Patent No.: US 6,378,789 B1
(45) Date of Patent: Apr. 30, 2002

(54) COMBINATION SPRAY APPARATUS

(75) Inventors: Charles E. Seaman, Jr., Kenosha, WI (US); Jeffrey Y. Chen, Seattle, WA (US); John A. Boticki; Carey W. Zimmerman, both of Racine, WI (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/585,849

(22) Filed: Jun. 1, 2000

(51) Int. Cl.[7] ..... B05B 7/30; A62C 31/00

(52) U.S. Cl. ..... 239/443; 239/310; 239/312; 239/318; 239/353; 239/354; 239/407; 239/413; 239/414; 239/416.1; 239/436; 239/527; 239/528; 239/444; 137/889; 137/894

(58) Field of Search ..... 239/310, 312, 239/318, 335, 353, 354, 407, 413, 414, 415, 416.1, 436, 443, 444, 525, 526, 527, 528; 137/889, 894

(56) References Cited

U.S. PATENT DOCUMENTS 2,726,898 A * 12/1955 Henriksson ..... 239/525
3,032,278 A * 5/1962 Thomas et al. ..... 239/412 X
3,049,303 A * 8/1962 Kocher ..... 239/312
3,128,949 A * 4/1964 Kaufman ..... 239/312
3,134,545 A * 5/1964 Armond ..... 239/312
3,207,443 A * 9/1965 Gilmour ..... 239/312
3,717,283 A 2/1973 Gulbrandsen ..... 222/76
3,802,628 A * 4/1974 Goss et al. ..... 239/527 X
3,900,163 A * 8/1975 Volker ..... 239/414 X
3,907,205 A * 9/1975 Shreve ..... 239/335 X
4,836,414 A 6/1989 Credle, Jr. et al. ..... 222/1
5,160,093 A * 11/1992 Battaglia ..... 239/444
5,476,193 A 12/1995 Haynes ..... 222/129.2

* cited by examiner

*Primary Examiner*—Robin O. Evans
(74) *Attorney, Agent, or Firm*—Warren R. Bovee; Renee J. Rymarz; Neil E. Hamilton

(57) ABSTRACT

A combination spray apparatus which allows for the selection of several different flowable materials to be sprayed from a single unit and at the site of the unit itself. In the preferred manner, the spray apparatus includes a trigger nozzle as well as the selection of two different materials to be sprayed through a second barrel portion. An eductor it utilized to draw selected materials into a spray stream. The combination spray apparatus is operable with water pressures which are customary to most cities and industries.

12 Claims, 5 Drawing Sheets

COMBINATION SPRAY APPARATUS

CROSS-REFERENCE TO RELATED APPLICATIONS

NONE

STATEMENT REGARDING FEDERALLY SPONSORED RESEARCH OR DEVELOPMENT

NONE

BACKGROUND OF THE INVENTION

This invention relates generally to apparatus for mixing and spraying fluid materials. More particularly, it relates to such apparatus wherein the selection of sprayable materials can be made in conjunction with the apparatus.

BACKGROUND ART

It is customary to provide a single nozzle or wand from which can be sprayed a variety of fluid materials. For example, at a do-it-yourself car wash, soap, water and wax can be sprayed from a single wand. However, the selection of these materials must be made at a site remote from the wand.

It is also known in the art to provide dispensing apparatus for dispensing different materials through a nozzle. For example, in U.S. Pat. No. 5,476,193, a beverage dispensing apparatus is disclosed which dispenses through a nozzle a preestablished volume of a syrup and a preestablished volume of a soda to be intermixed within a nozzle prior to being dispensed into a container. In U.S. Pat. No. 4,836,414 a premixed dispensing system is disclosed wherein several beverages can be selected by pushing independent selection buttons which control independent dispensing valves and independent nozzles. A three-grade gasoline dispensing system wherein an intermediate grade is provided by mixing two other grades through pump arrangement is described in U.S. Pat. No. 3,717,283.

SUMMARY OF THE INVENTION

The prior art does not provide a sprayer device which provides for the selection of different sprayable materials and can dispense the different fluid materials from a single body member.

It is an advantage of the invention to provide a sprayer apparatus which affords a selection of sprayable materials in direct conjunction with the sprayer device.

It is another advantage of the invention to provide a sprayer apparatus of the foregoing type which can mix two fluid materials.

It is still another advantage of the invention to provide a sprayer apparatus which has a siphoning function for a fluid material.

It is yet another advantage of the invention to provide a sprayer apparatus which is easily manipulated.

The foregoing advantages are accomplished in one aspect by the sprayer apparatus of this invention which includes a main body portion with a flow passage formed through the main body portion. A first barrel and a second barrel are in fluid communication with the flow passage. A first valve member is connected to the first barrel and a second valve member connected to the second barrel with both the first and second valve members operatively associated with the flow passage.

In another aspect, an additional flow passage is in fluid communication with the second barrel.

In a preferred embodiment, an eductor is operatively associated with the second barrel.

In another preferred embodiment, there are two flow passages in fluid communication with the eductor.

In still another aspect, there are two valve members each connected to one of the two flow passages and constructed and arranged to separately open and close the two passages, the two valve members are operable by a single control apparatus which includes a first gear with a camming surface and a second meshed gear which operates the second valve member.

In yet another aspect, the second valve member is an on/off valve and the first valve member includes a trigger mechanism.

DESCRIPTION OF PREFERRED EMBODIMENTS

Figure 1:
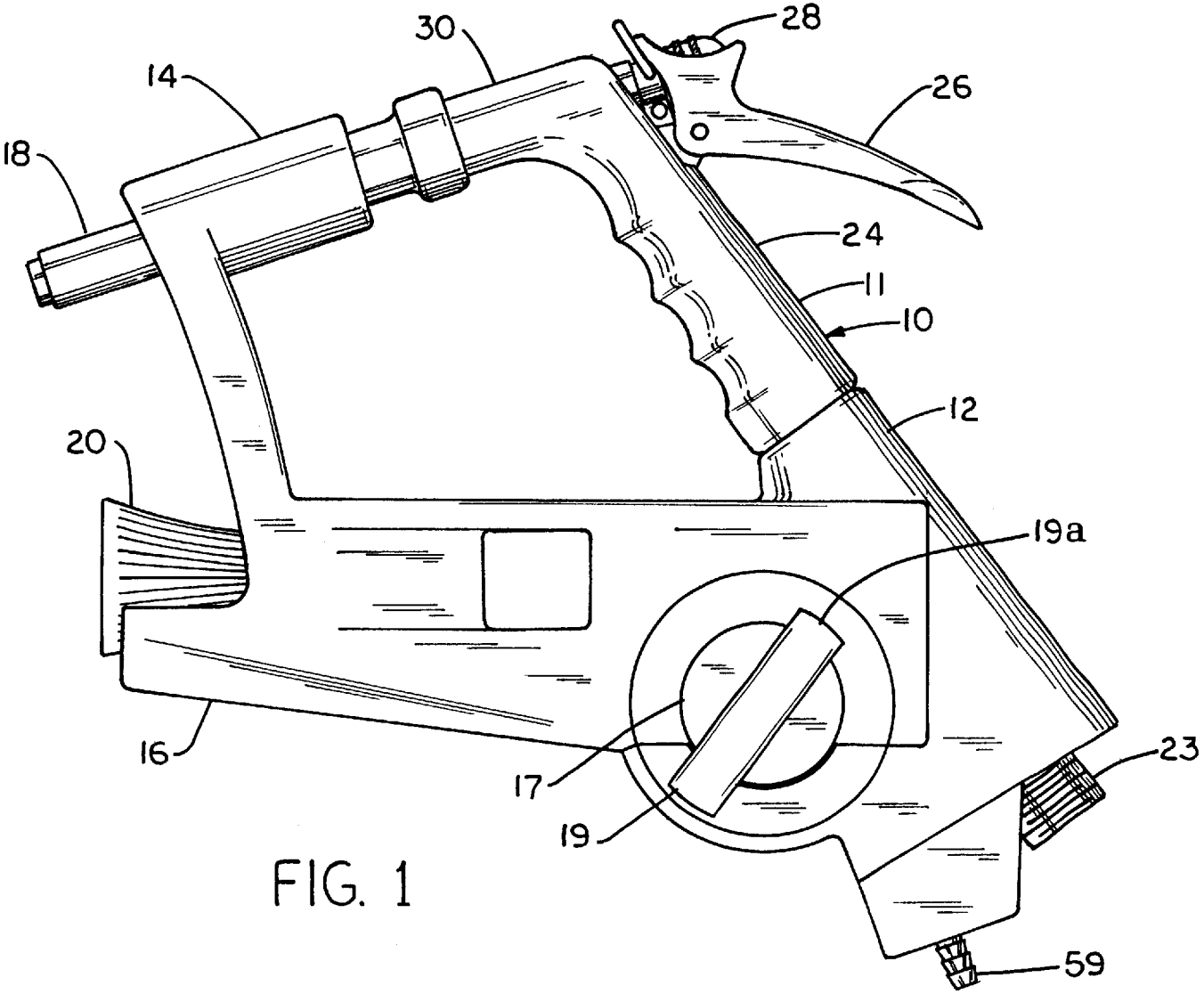
FIG. 1 is a side view of the sprayer apparatus of this invention.
Figure 2:
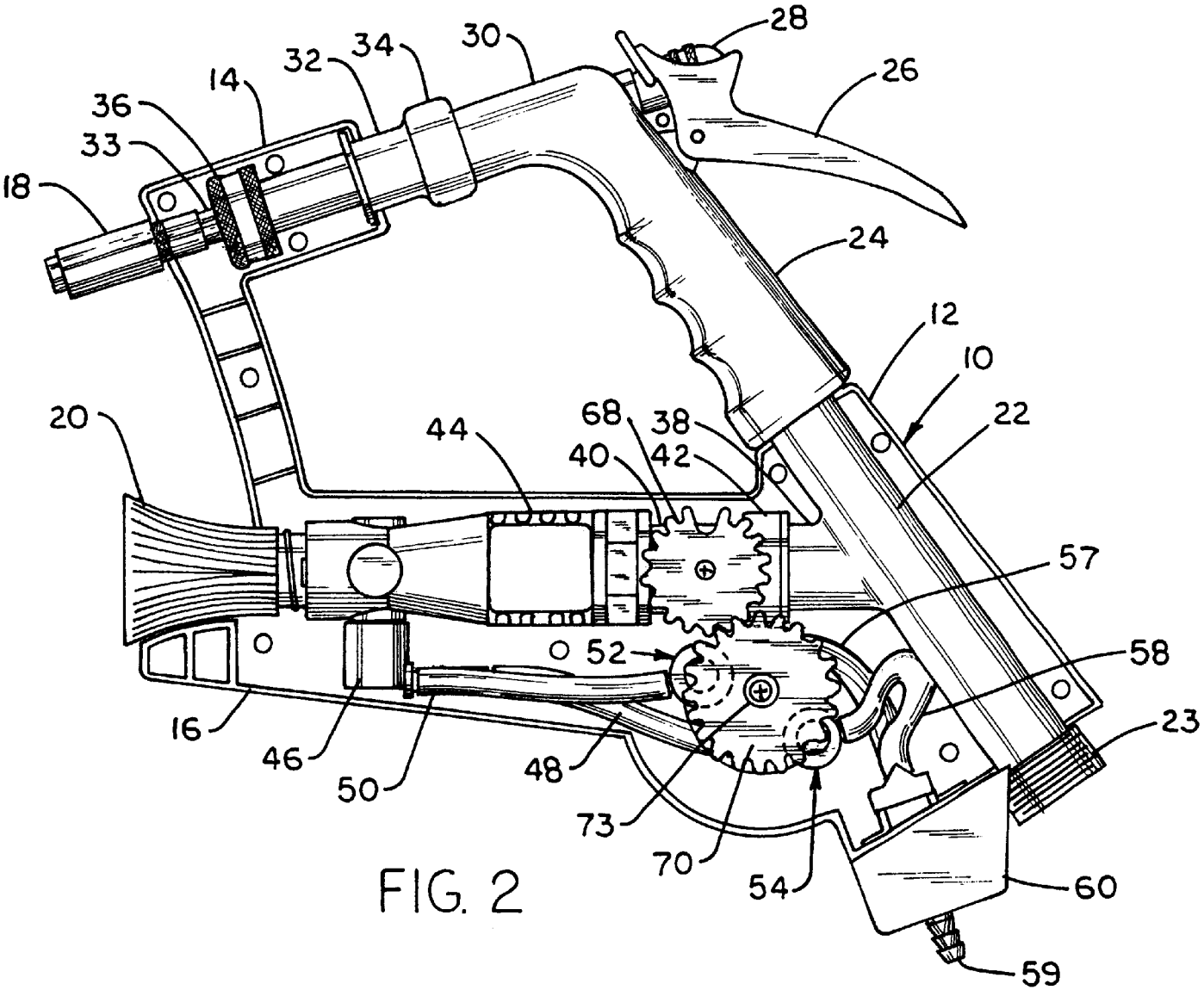
FIG. 2 is a view similar to FIG. 1 with portions broken away.

As shown in FIGS. 1 and 2, the combination spray apparatus generally 10 includes a body 12 having a first barrel 14 and a second barrel 16. A spray head 18 extends from barrel 14 and a second spray head 20 extends from barrel 16. A liquid passage 22 in the form of a hollow tube is disposed inside the body 12. It has internal threads 23 for connection to a source of liquid such as a hose. Fluid passage 22 connects also with a hollow handle 24 of a typical trigger nozzle such as sold by the Gilmour Company in Louisville, Ky. It includes a trigger lever 26 which controls a rod 28 inside nozzle portion 30. Connected to nozzle portion 30 is an attachment member 32 having a nut 34 for connecting to nozzle portion 30. A second nozzle portion 33 connects to the attachment member 32 by means of the nut 36. The spray head 18 slidably engages the second nozzle portion 33.

When a source of liquid is connected to liquid passage 22, it will flow through the handle grip portion 24 and the flow controlled in nozzle portion 30 by the rod 28 and the trigger lever 26. The flow will continue through the attachment member 32 and into the second nozzle portion 33 where the adjustment of the spray will be controlled by the spray head 18.

A branch liquid passage 38 is also in fluid communication with liquid passage 22. It supplies liquid to a valving device 40 of the on/off type. It is connected to the branch fluid passage by the nut 42. An eductor 44 of the type disclosed in U.S. Pat. No. 5,927,338 connects to the valving device 40 and includes an inlet port 46 to which is connected the supply lines 48 and 50. The adjustable spray head 20 engages the eductor 44 at the end thereof.

Figure 3:
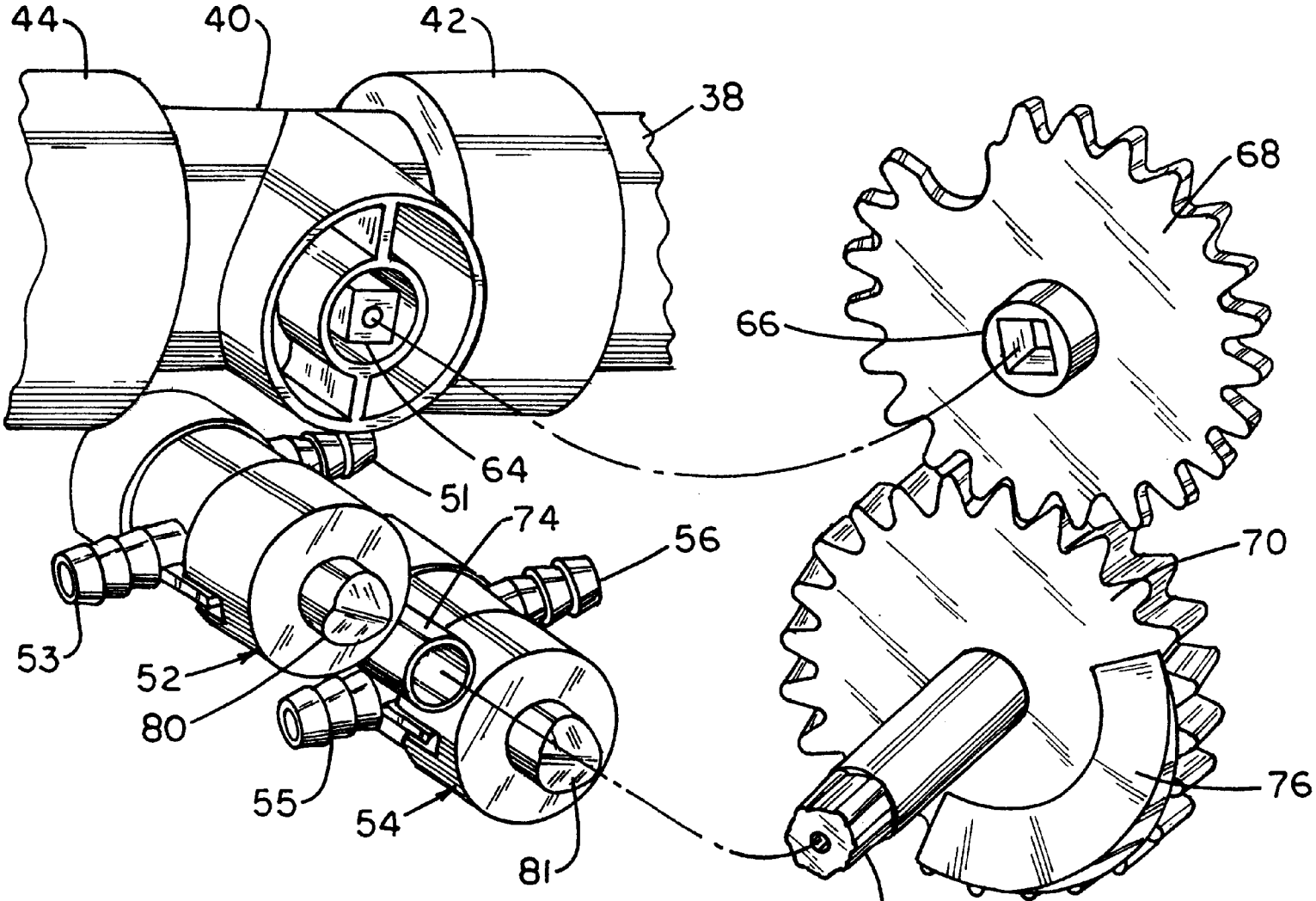
FIG. 3 is a partial exploded view of the sprayer apparatus.

Referring to FIG. 3 it is seen that there are two valves 52 and 54 to which liquid flow is regulated through the lines 48 and 50 to the eductor 44. Liquid is supplied to these valves by the lines 58 and 57. Suitable fittings such as 53, 51, 55 and 56 are provided on the valves 52 and 54, respectively for this purpose. Lines 57 and 58 are in fluid communication with inlet fittings such as 59 extending from housing 60. The flow of liquid through the valves 52 and 54 is controlled by the gear 70 which has the axle 72 for rotatably fitting into collar 74 which is connected to the body 12. Valves 52 and 54 are also secured to body 12 and are actuated by the contact of the cam surface 76. Gear 70 drives gear 68 which has the cap 66 for engagement with the stem 64 of the valve 40.

Figure 6:
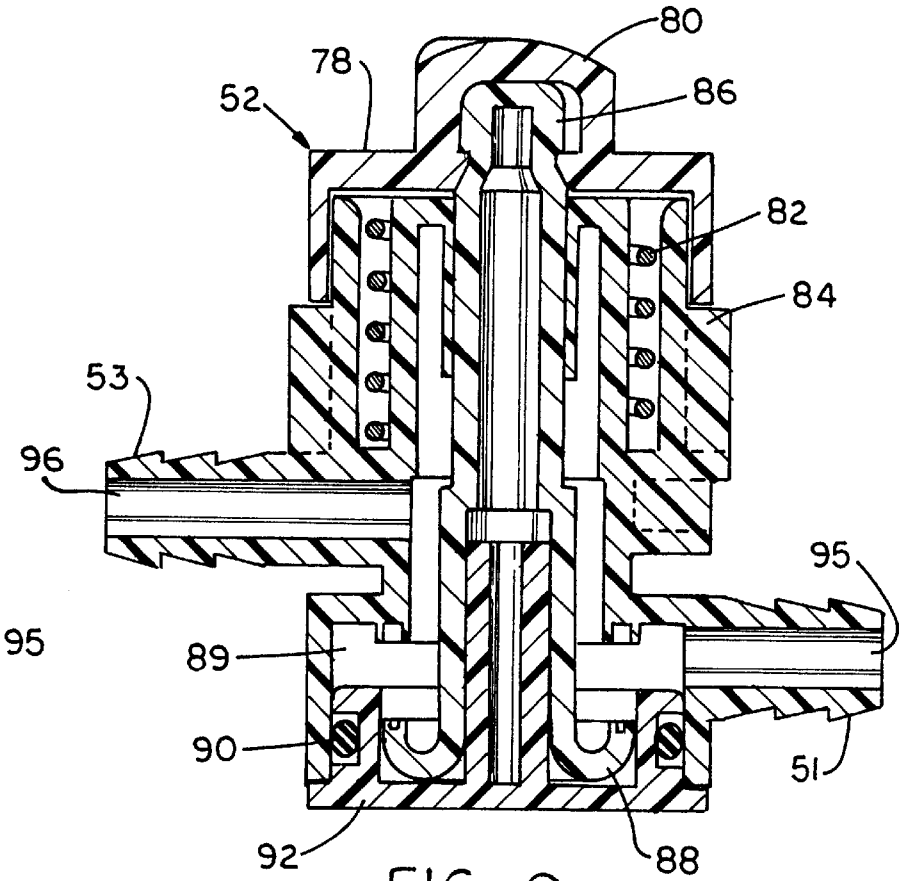
FIGS. 5 and 6 are sectioned views of the valve member shown in FIG. 4.

Each of the valves 52 and 54 are of the same construction. Accordingly, only valve 52 is shown in detail in FIGS. 4–6. It includes the valve body 84 in which is slidably mounted a plunger 86 having a seal portion 88. The plunger is activated by the cam contact 80 which is guided over the valve body 84 by the flange section 78. A spring 82 biases the cam contact upwardly as well as the plunger 86 with respect to the housing 84. Valve 52 is shown in the closed position in FIG. 5. There it will be seen that the seal portion 88 is positioned in the channel 89 formed between the housing 84 and the valve cap 92. An appropriate seal 90 is placed between the housing 84 and the cap 92. A slot 85 is provided in the housing 84 to accommodate the end section 83 of the seal portion 88. This affords a seal tight condition for the valve when the plunger is in the closed position FIG. 6 represents the valve 52 in an open position. As shown, the cam contact 80 has been moved downwardly and accordingly so has the plunger 86. This causes the seal portion 88 to move downwardly and out of the channel 89 thereby permitting liquid flow from inlet 51 to outlet 53.

OPERATION

A better understanding of the combination spray apparatus 10 as well as its unique features will be had by description of its operation. A source of water such as from a hose is connected to the threads 23 and the fluid passage 22. A source of detergent such as Break-Up, available from Johnson Wax Professional of Sturtevant, Wis., is connected to the inlet 59. A source of sanitizer such as J-512, also available from Johnson Wax Professional, is connected to a similar inlet through housing 60 which is in fluid communication with the line 57. The end 19*a* of the handle 19 of the control knob 17 is placed in a 12 o'clock position as viewed in FIG. 1. In this position valve 40 is in a closed position so that no water is flowing through the eductor 44. Water flows through the handle grip portion 24 of the trigger nozzle 11 as well as the nozzle portion 30. Water is sprayed through the spray head 18 by means of the activation of the trigger lever 26. After suitable spraying has taken place, the detergent can then be applied by means of the eductor 40. This is accomplished by turning the handle 19 in a counterclockwise position so that the end 19*a* is in a 9 o'clock position. Before this movement, it will be appreciated that valve 40 is in a closed position so that no water is flowing through the eductor. When handle 19 is moved to the previously mentioned 9 o'clock position valve 40 will open allowing water to flow through the eductor. This is effected by a cap (not shown) on the inside of knob 17 engaging the axle 73 (see FIG. 2) of gear 70 which in turn rotates gear 68 and the stem 64. At the same time, the inside cam surface 76 of gear 70 will move over the cam contact 81 of valve 54 to allow a siphoning of detergent from line 58 through the valve 54, through line 48, to the eductor 44 and consequently out through the spray head 20. After the application of the detergent, it may be desirable to apply a sanitizer. This is accomplished by rotating the handle 19 and the end portion 19*a* to a 3 o'clock position. This opens the valve 40 by the opposite rotation of gear 68 as well as opens the valve 52 by movement of the cam surface 76 over the cam contact 80 of valve 52. This allows a siphoning of sanitizer from line 57, through valve 52, through line 50 to supply sanitizer to the eductor 44 and ultimately the spray head 20.

It should be pointed out that the eductor described in U.S. Pat. No. 5,927,388 is particularly suitable for use with the combination spray apparatus. This is because of its backflow tolerances which substantially reduces the chance of liquid flowing back though the air gap irrespective of any back pressure created by the spray head 20.

Figure 4:
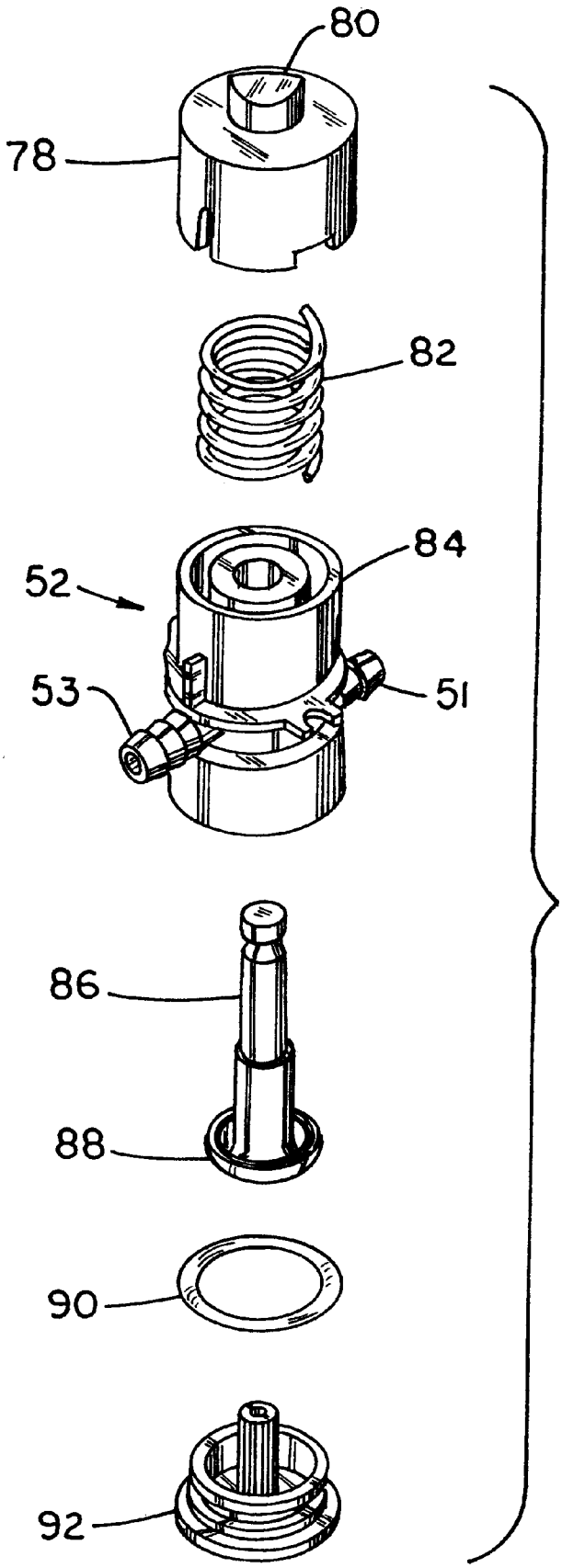
FIG. 4 is an exploded view of a valve member for use in the sprayer apparatus.

Referring to FIGS. 4 and 6, it is seen that the spring 82 is accommodated in housing 84 in a manner to be isolated from the flow passage through the valve 52 as represented by the input and output passages 95 and 96, respectively, and the channel 89. This protects the spring 82 from contact with any corrosive or degrading fluid materials in the passages and channel.

Figure 5:
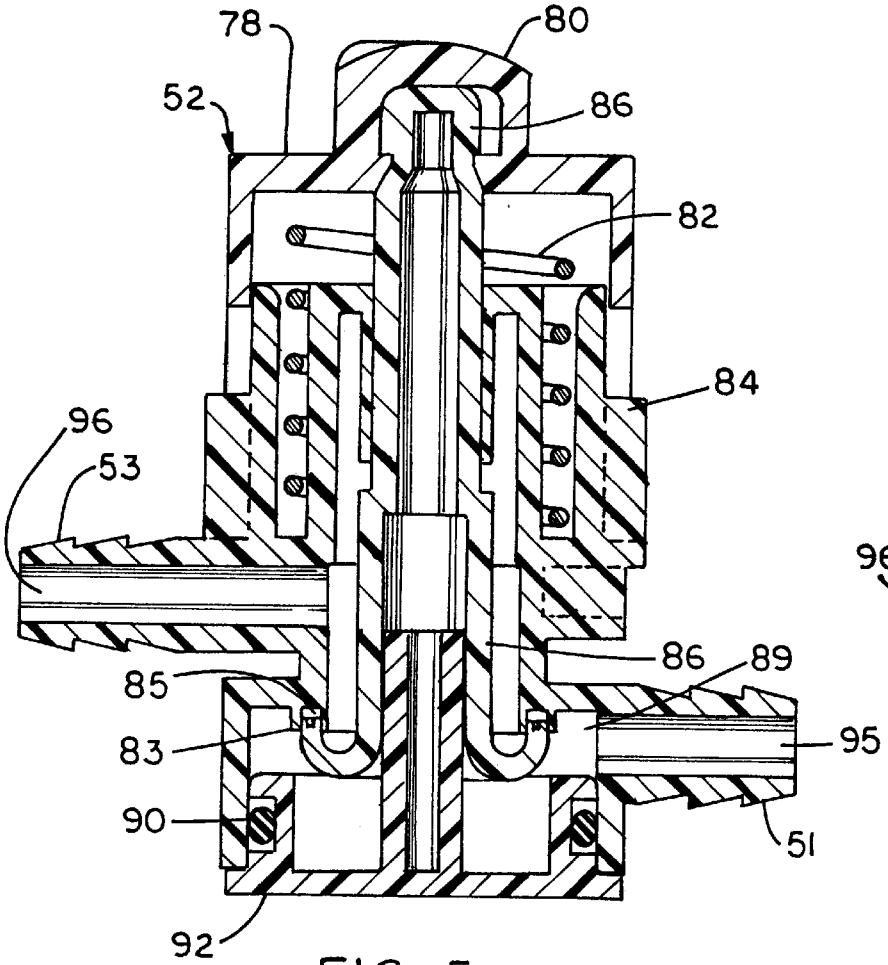

Another feature of the valves 52 and 54 is the configuration of the plunger 86. As best seen in FIGS. 5 and 6 the seal portion is of a turned up J-shaped configuration so that a sealing mechanism is located along and parallel to the direction of motion of the plunger and not perpendicular. This assures that any wearing of the plunger surfaces does not degrade the quality of the seal as no wear occurs on the major sealing surface.

It will thus be seen that there is now provided a combination spray apparatus which can afford the selection of materials to be sprayed directly in conjunction with the spray apparatus and without having to move to a control source. This is advantageous not only from a time saving standpoint but also from the standpoint of convenience where the spraying nozzle may be used in a difficult to reach position. The combination spray apparatus of this invention has been illustrated for use in conjunction with the spraying of both a detergent and an sanitizer material. It is obvious that it could be utilized to advantage with only the spraying of one additional material such as the detergent or the sanitizer. This can be accomplished through utilization of only one of the valve members such as 52 or 54. Further, while a particular trigger nozzle has been indicated for use in the combination spray apparatus, other styles and designs could be incorporated. Neither is the particular design of the body 12 of critical importance. Other geometric configurations could also be utilized. All such and other modifications within the spirit of the invention are meant to be within its scope as defined by the appended claims.

What is claimed is:

1. A sprayer apparatus having at least two barrels comprising:

a main body portion;

a first flow passage formed through the main body portion;

a first barrel and a second barrel in fluid communication with the main body portion and the first flow passage;

a first valve member connected to the first barrel;

a second valve member connected to the second barrel, both the first and second valve members operatively associated with the first flow passage;

at least second and third flow passages operatively associated with the second barrel; and a third valve member connected to the second and third flow passages.

2. The sprayer apparatus as defined in claim 1, further including an additional flow passage in fluid communication with the second barrel.

3. The sprayer apparatus as defined in claim 1, further including an eductor operatively associated with the second barrel.

4. The sprayer apparatus as defined in claim 1, wherein the second valve member is an on/off valve.

5. The sprayer apparatus as defined in claim 1, wherein the first valve member includes a trigger mechanism.

6. A double-barreled sprayer apparatus comprising:

a main body portion;

a flow passage formed through the main body portion;

a first barrel and a second barrel in fluid communication with the main body portion and the flow passage;

a first valve member connected to the first barrel;

a second valve member connected to the second barrel, both the first and second valve members operatively associated with the first flow passage;

an eductor operatively associated with the second barrel; and second and third flow passages in fluid communication with the eductor.

7. The sprayer apparatus as defined in claim 6, further including third and fourth valve members each operatively connected to one of the second and third flow passages and constructed and arranged to separately open and close the second and third passages.

8. The sprayer apparatus as defined in claim 7, wherein the second valve member and the third and fourth valve members are operable by a single control apparatus.

9. The sprayer apparatus as defined in claim 8, wherein the single control apparatus includes a first gear constructed and arranged to operate the third and fourth valve members and a second gear meshed with the first gear, the second gear connected to the second valve member.

10. The sprayer apparatus as defined in claim 9, wherein the first gear includes a camming surface to engage the third and fourth valve members.

11. The sprayer apparatus as defined in claim 7, wherein the third and fourth valve members include a spring constructed and arranged to be isolated from the second and third flow passages.

12. The sprayer apparatus as defined in claim 7, wherein the third and fourth valve members include a plunger having a sealing portion which is substantially J-shaped.

* * * * *